US010617189B2

(12) United States Patent
Lee et al.

(10) Patent No.: US 10,617,189 B2
(45) Date of Patent: Apr. 14, 2020

(54) HAIR IRON

(71) Applicants: Myoung Jun Lee, La Habra, CA (US); Sean Yonghak Lee, Fullerton, CA (US)

(72) Inventors: Myoung Jun Lee, La Habra, CA (US); Sean Yonghak Lee, Fullerton, CA (US)

( * ) Notice: Subject to any disclaimer, the term of this patent is extended or adjusted under 35 U.S.C. 154(b) by 475 days.

(21) Appl. No.: 15/455,073

(22) Filed: Mar. 9, 2017

(65) Prior Publication Data

US 2018/0213908 A1 Aug. 2, 2018

Related U.S. Application Data

(60) Provisional application No. 62/452,925, filed on Jan. 31, 2017.

(51) Int. Cl.

| | |
|---|---|
| ***A45D 1/02*** | (2006.01) |
| ***A45D 2/00*** | (2006.01) |
| ***A45D 1/06*** | (2006.01) |
| ***A45D 1/04*** | (2006.01) |
| ***A45D 1/28*** | (2006.01) |
| *A45D 1/00* | (2006.01) |

(52) U.S. Cl.

CPC ..... *A45D 2/001* (2013.01); *A45D 1/04* (2013.01); *A45D 1/06* (2013.01); *A45D 1/28* (2013.01); *A45D 2001/008* (2013.01)

(58) Field of Classification Search

CPC ... A45D 1/00; A45D 1/02; A45D 1/04; A45D 1/06; A45D 1/08; A45D 1/14; A45D 1/28; A45D 2001/008; A45D 2/001

See application file for complete search history.

(56) References Cited

U.S. PATENT DOCUMENTS

| | | | | |
|---|---|---|---|---|
| 1,179,938 A * | 4/1916 | Krebs | ..... | A45D 1/02 126/409 |
| 2002/0190047 A1* | 12/2002 | Nam | ..... | A45D 1/04 219/222 |
| 2013/0192625 A1 | 8/2013 | Migliori et al. | | |

FOREIGN PATENT DOCUMENTS

| | | |
|---|---|---|
| KR | 200255099 | 12/2001 |
| KR | 101172962 | 11/2011 |
| KR | 1020140058494 | 5/2014 |

OTHER PUBLICATIONS

Patent Translate by EPO and Google; KR101172962 Sook Nov. 30, 2011 (Year: 2011).*

Korean Intellectual Property Office Application No. 10-2017-0045099, Office Action dated Jul. 3, 2017, 5 pages.

* cited by examiner

*Primary Examiner* — Rachel R Steitz

(74) *Attorney, Agent, or Firm* — Lee, Hong, Degerman, Kang & Waimey

(57) ABSTRACT

The present disclosure relates to a hair iron, the hair iron including a first body and a second body, a first cover, a second cover, a first heater, a second heater, and a cartridge, whereby damage to user hair and a safety accident can be prevented by styling the user hair at a relatively lower temperature, and insufficient hair styling caused by low temperature can be effectively complemented by coating hair treatment material on the user hair through evaporation of the hair treatment material.

4 Claims, 5 Drawing Sheets

HAIR IRON

CROSS-REFERENCE TO RELATED APPLICATIONS

Pursuant to 35 U.S.C. § 119(e), this application claims the benefit of U.S. Provisional Patent Application No. 62/452,925, filed on Jan. 31, 2017, the contents of which are hereby incorporated by reference herein in their entirety.

TECHNICAL FIELD

The present disclosure relates to a hair iron, and more particularly, to a hair iron configured to style a user hair by minimizing damage to the user hair with a low temperature, and by vaporizing a styling material.

BACKGROUND

In general, a hair styling appliance is a device in which hair is compressed using heat generated by a heating device to form a wave on hair, or to straighten curly hair to straight hair.

The hair styling appliance are more efficient in its effect at a high temperature, such that conventional hair styling appliances are generally set at a high temperature (e.g., over 150° C.) for an operated heat-transmitting temperature, whereby there have occurred many instances where a user was developed with hair damages or burns caused by the high temperature due to erroneous operation or inattention during use of hair styling appliance to thereby pose a safety problem.

As one of the measures to prevent these problematic instances, the Korean Laid-Open Patent No.: 10-2014-0058494 (laid open on May 14, 2014) disclosed a hair treatment device for controlling a dynamic, optimal hair styling temperature configured to adjust a temperature, and a method thereof. However, the Korean Laid-Open Patent No.: 10-2014-0058494 (Laid Open on May 14, 2014) still suffers from problems or disadvantages in that hair is damaged or a user is burnt due to an ideal temperature being set at 150° C.~232.22° C. in order to perform an effective hair styling.

SUMMARY

Technical Challenge

The present disclosure is presented to solve the conventional problems or disadvantages and one of purposes of the present disclosure is to provide a hair iron configured to style a user hair even at a relatively low temperature.

Another object of the present disclosure is to provide a hair iron configured to prevent damage to a user hair by generating a heat corresponding to a relatively low temperature.

Still further object of the present disclosure is to provide a hair iron configured to effectively perform a hair styling by complementing an insufficient effect of hair styling due to a relatively low temperature by evaporating a hair treatment material and by coating the evaporated hair treatment material on a user hair.

Technical Solution

In order to achieve at least the above objects, in whole or in part, and in accordance with the purposes of the present disclosure, as embodied and broadly described, and in a general aspect, there is provided a hair iron, the hair iron including:

first and second bodies, each body facing the other body, each one side being connected through a hinge member, and a user hair being arranged between each other side of the first and second bodies;

a first cover attachably and detachably formed on the first body by being arranged at the other side of the first body to form a first inner space along with the first body and to transmit a heat to the user hair;

a second cover arranged at the other side of the second body to face the first cover and to transmit a heat to the user hair;

a first heater configured to generate a heat by being accommodated into the first body and to transmit a heat to the first cover;

a second heater configured to generate a heat by being accommodated into the second body to face the first heater and to transmit a heat to the second cover; and a cartridge including a liquefied hair styling material evaporable by the generation of heat of the first heater, the cartridge being arranged inside of the first inner space.

In some exemplary embodiments, the second cover may generate a second inner space along with the second body, and may be attachably and detachably formed on the second body, and wherein the hair iron includes a cartridge arranged at the second inner space, and includes the liquefied hair styling material that is evaporable by the heat generated from the second heater.

In some exemplary embodiments, the first cover or the second cover may include an opening, opened at both distal ends, to insert and extract the cartridge, and at least one evaporation hole to allow the hair treatment material to pass therethrough by being evaporated from the cartridge.

In some exemplary embodiments, the first cover or the second cover may be slidable along a lengthwise direction of the first body or along a lengthwise direction of the second body.

In some exemplary embodiments, the first cover or the second cover may include a sliding part bent at both distal ends of widthwise direction toward an inside thereof, and a sliding groove formed at an inside to correspond to the sliding part, wherein the first body or the second body may include, a hitching lug so protruded as to be inserted into the sliding groove, and a hitching groove concavely formed at one side of the hitching lug to allow the sliding part to be inserted, and wherein the first cover or the second cover may prevent the sliding part from being deviated by being hitched at the hitching lug.

In some exemplary embodiments, the evaporation hole may be formed along a widthwise direction of the first cover or the second cover.

In some exemplary embodiments, the evaporation hole may be zigzag arranged along a lengthwise direction of the first cover or the second cover.

In some exemplary embodiments, the evaporation hole may be formed along a lengthwise direction of the first cover or the second cover in a plural number.

In some exemplary embodiments, the evaporation hole may be zigzag arranged along a lengthwise direction or a widthwise direction of the first cover or the second cover.

In some exemplary embodiments, the hair iron may further comprise a temperature adjusting part settable of a temperature according to a user intention, wherein the first heater or the second heater may generate a heat at a user's set temperature when the first cover and the second cover are mutually contacted, and generate a heat at a temperature lower than the user's set temperature when the first cover and the second cover are mutually separated.

Advantageous Effect

The present disclosure has an advantageous effect in that damage to user hair and a safety accident can be prevented by styling the user hair at a relatively lower temperature. Another advantageous effect is that insufficient hair styling caused by low temperature can be effectively complemented by coating hair treatment material on the user hair through evaporation of the hair treatment material.

DETAILED DESCRIPTION

Figure 1A:
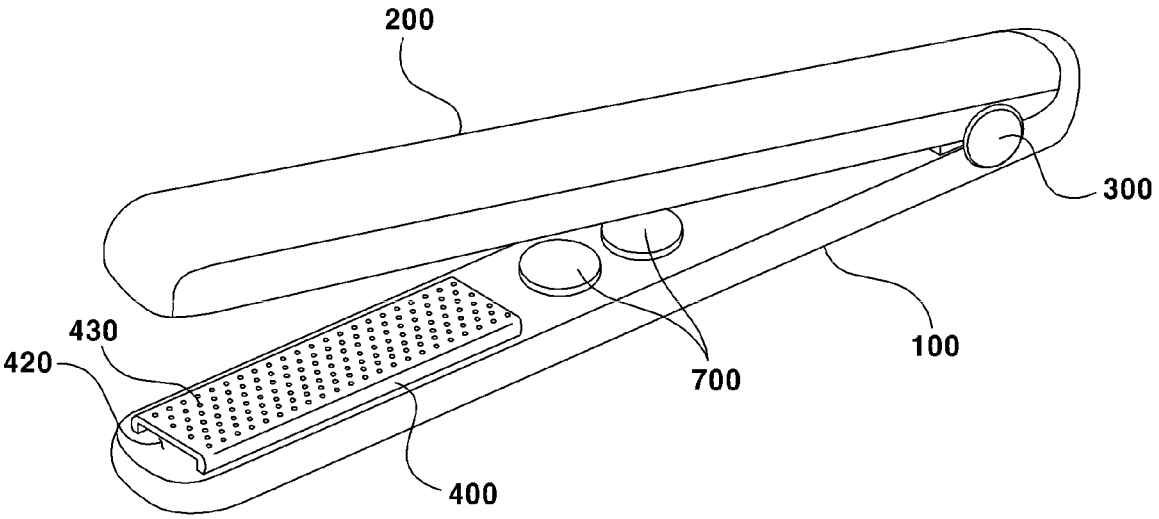
FIGS. 1A and 1B are perspective views illustrating a hair iron according to an exemplary embodiment of the present disclosure.

Hereinafter, some exemplary embodiments of the present disclosure will be described in detail with reference to the enclosed figures. The same reference numerals will be assigned to the same or similar elements in the explanations of the figures even if indicated on different drawings. Thus, the redundant explanation and description of the same configuration may be omitted.

In other instances, well-known methods, procedures, components, circuits, and networks have not been described in detail so as not to unnecessarily obscure aspects of the embodiments.

Although the terms first, second, third, A, B, (a) and (b), etc., may be used herein to describe various elements, components, regions, layers and/or sections, these elements, components, regions, layers and/or sections should not be limited by these terms. These terms may be only used to distinguish one element, component, region, layer or section from another region, layer or section.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.).

In addition, various exemplary embodiments will be described more fully hereinafter with reference to the enclosed figures, in which some exemplary embodiments are shown. The present inventive concept may, however, be embodied in many different forms and should not be construed as limited to the exemplary embodiments set forth herein. Rather, the described aspect is intended to embrace all such alterations, modifications, variations, and equivalents that fall within the scope and novel idea of the present disclosure.

As used herein, the singular forms "a", "an" and "the" are intended to include the plural forms as well, unless the context clearly indicates otherwise.

As used herein, the terms such as "include" or "have" are to state that there may be in existence of features, numbers, steps, functions, elements, components described herein, or compositions thereof. Therefore, they shall not be understood as to exclude the possibility of existence or addition of one or more other features, numbers, steps, functions, elements, components described herein, or compositions thereof.

Furthermore, the terms of "hair iron" and "hair iron appliance" may be interchangeably used herein. The terms of "user hair," "user's hair" and simply "hair" may be interchangeably used herein. Still furthermore, the terms of "hair treatment material" and "hair styling material" may be also interchangeably used herein.

Now, a hair iron according to exemplary embodiments of the present disclosure will be described in detail with reference to the enclosed drawings.

Figure 1B:
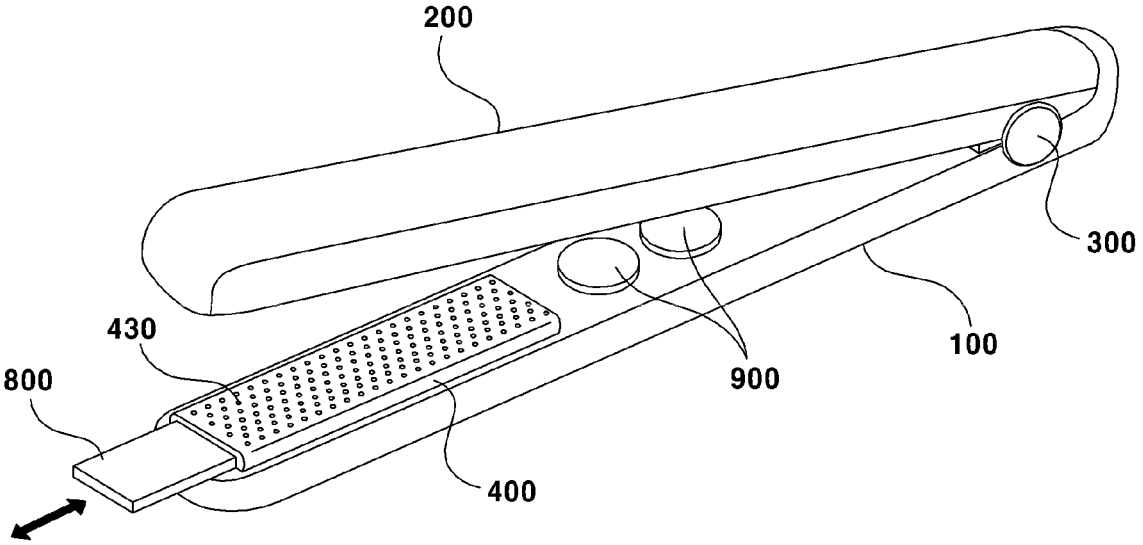
Figure 2:
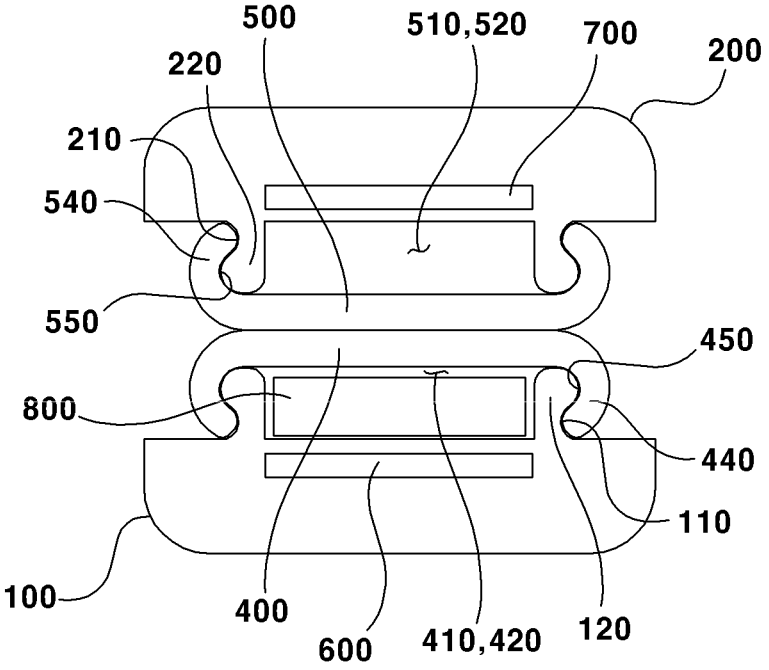
FIG. 2 is a front view seen from a distal end of a hair iron according to an exemplary embodiment of the present disclosure.

FIGS. 1A and 1B are perspective views illustrating a hair iron according to an exemplary embodiment of the present disclosure, FIG. 2 is a front view seen from a distal end of a hair iron according to an exemplary embodiment of the present disclosure, and FIG. 3 illustrates modified examples of an evaporation hole formed on a cover of hair iron according to an exemplary embodiment of the present disclosure.

Referring to FIGS. 1A and 1B, a hair iron according to an exemplary embodiment of the present disclosure may include a first body (100), a second body (200) and a hinge member (300).

The first body (100) and the second body (200), each having a shape of a rod, may be so arranged as to face each other in order to allow being grasped by a user. Each one side of the first and second bodies (100, 200) may be connected by the hinge member (300), and the first and second bodies (100, 200) may be rotated about the hinge member (300). A user may grasp the first and second bodies (100, 200), where a user hair may be styled by being positioned between the first and second bodies (100, 200) and by pursing, by a user, the first and second bodies (100, 200).

Referring to FIG. 2, each other side of the first and second bodies (100, 200) may be provided with a hitching groove (110, 210) and a hitching lug (120, 220) to allow a cover (400, 500, described later) to slide. That is, a first hitching lug (120) may be protruded toward the second body (200), and one side of the first hitching lug (120) may be concavely formed with a first hitching groove (110). The first cover (400, described later) may be prevented from being deviated by being fastened to the first hitching lug (120) and the first hitching groove (110). Meantime, the second body (200) may be provided with the second hitching groove (210) and the second hitching lug (220) symmetrically with the first body (100).

As noted from the foregoing, each other side of the first body (100) and the second body (200) may be disposed with a cover (400, 500). The other side of the first body (100) may be so arranged as to allow the first cover (400) to face the second body (200), and the other side of the second body (200) may be so arranged as to allow the second cover (500) to face the first body (100). The cover (400, 500) may be increased in temperature by being heated while a heater (600, 700, describer later) receives a current, where means supplying the current is not particularly limited to any one means, and a manufacturer may adopt various means as long as the cover (400, 500) can be increased in temperature. For example, the cover (400, 500) may be provided with a heat transmission means (not shown) configured to transmit the generation of heat by the heater (600, 700) so as to be increased in temperature by the generation of heater (600, 700).

The first cover (400) may form a first inner space (410) along with the first body (100). The first cover (400) may include a first opening (420), an evaporation hole (430), a first sliding part (440) and a first sliding groove (450).

The first cover (400) may be slid by a user to a lengthwise direction of the first body (100) according to a user intention to allow the first inner space (410) to be exposed to an outside.

Referring to FIG. 3A, 3B, 3C, and 3D, the first cover (400) may be provided with various shapes of evaporation holes (430). The first inner space (410) may be inserted into by a cartridge (800, described later) through a first opening (420), or the cartridge may be removed from the first inner space (410). The first heater (600) may be heated by supply of power, and liquefied hair styling material included in the cartridge (800) may be evaporated by the generation of heat, and the evaporated hair styling material may be discharged to the outside through the evaporation holes (430) to be coated on the user hair.

Figure 3A:
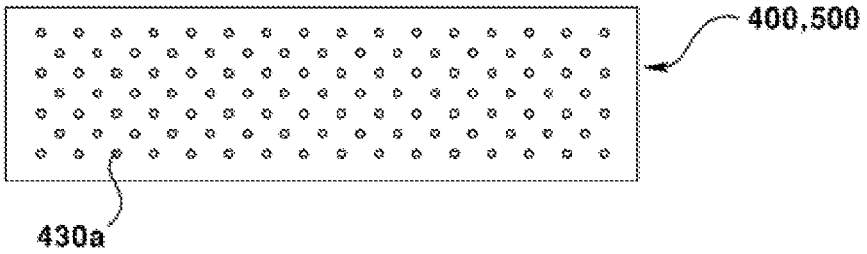
FIG. 3A, 3B, 3C, and 3D illustrate modified examples of an evaporation hole formed on a cover of hair iron according to an exemplary embodiment of the present disclosure.

Referring to FIG. 3A, as an example of evaporation holes (430), and each of evaporation holes (430*a*) may take a general round shape, and a plurality of evaporation holes (430*a*) may be formed by allowing the cover (400, 500) to be perforated. At this time, the evaporation hole (430*a*) may take a predetermined size and arrangement on the cover (400, 500). For example, the evaporation hole (430*a*) may maintain equidistance from an adjacent evaporation hole (430*a*).

Figure 3B:
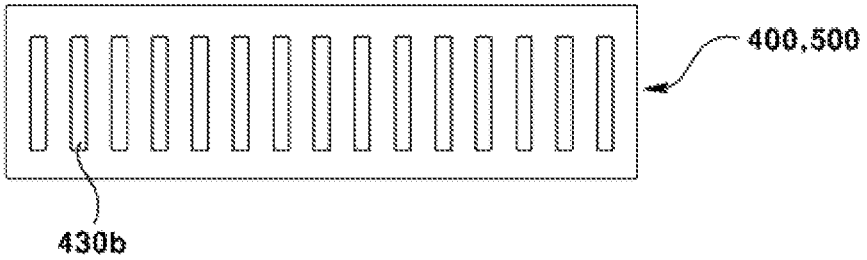

Referring to FIG. 3B, as another modified example of evaporation hole (430), an evaporation hole (430*b*) may be so formed as to have a length to a widthwise direction of the cover (400, 500), and each evaporation hole (430*b*) may be arranged to a lengthwise direction of the cover (400, 500). At this time, the evaporation hole (430*b*) may maintain equidistance from an adjacent evaporation hole (430*b*). In this case, because the lengthwise direction of the evaporation hole (430*b*) and hair direction of a user come to match each other, a user can prevent the hair of the user from being caught between the first cover (400) and the second cover (500) when the user hair is pressed and slid while the user grasps the first body (100) and the second body (200), whereby the hair styling can be made more easily.

Figure 3C:
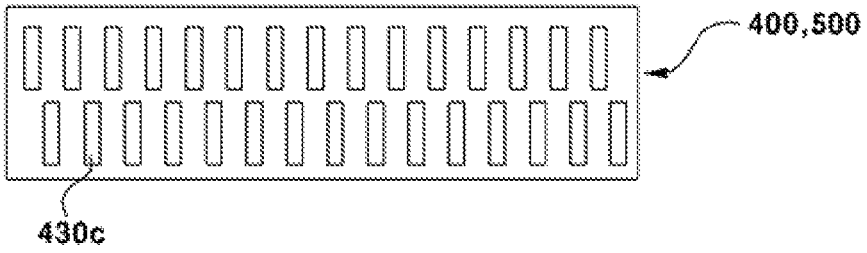

Still another modified example of evaporation hole (430), referring to FIG. 3C, a plurality of evaporation holes (430*c*) is so formed as to have a length to a widthwise direction of the cover (400, 500), and each of the evaporation holes (430*c*) may be zigzag arranged along a lengthwise direction of the cover (400, 500). At this time, as in FIG. 3B, the evaporation hole (430*c*) may be such that the lengthwise direction of the evaporation hole (430*b*) and hair direction of a user come to match each other, and because the evaporation holes (430*c*) are installed in between the evaporation holes (430*b*) of FIG. 3B, the user hair positioned between the first cover (400) and the second cover (500) can be entirely coated with hair styling material. That is, although the hair styling material evaporated through the evaporation holes (430*b*) of FIG. 3B is coated on a part of the user hair, the hair styling material evaporated through the evaporation holes (430*c*) of FIG. 3C can be coated on an entire area of user hair compressed between the first cover (400) and the second cover (500).

Figure 3D:
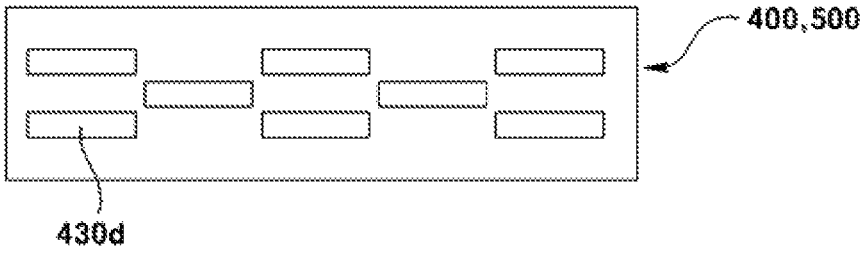

Still further modified example of evaporation hole (430) as illustrated in FIG. 3D, a plurality of evaporation holes (430*d*) is so formed as to have a length to a lengthwise direction of the cover (400, 500), and each of the evaporation holes (430*d*) may be zigzag arranged along a lengthwise or widthwise direction of the cover (400, 500). Thus, the hair styling material evaporated to the user hair compressed between the first cover (400) and the second cover (500) can be coated on an entire area of user hair through the evaporation holes (430*d*) of FIG. 3D, as in the evaporation holes (430*c*) illustrated in FIG. 3C.

The first cover (400) may include, at both distal ends of widthwise direction, a first sliding part (440) bent toward the first body (100). The first sliding part (440) may be provided at an inside of the first sliding part (440) with the first sliding groove (450) because of formation of the first sliding part (440). The first sliding part (440) may wrap the first hitching lug (120) of the first body (100) and a distal end thereof may be inserted into the first hitching groove (110), where the first hitching lug (120) may be inserted into the first sliding groove (450). A distal end of the first sliding part (440) inserted into the first hitching groove (110) may be prevented from being deviated because of being caught by the first hitching lug (120). The first cover (400) may slide to a lengthwise direction of the first body (100) in response to the user intention. That is, the first cover (400) may be attachably and detachably formed from the first body (100). When the first cover (400) is detached from the first body (100), the first inner space (410) is exposed to the outside, where the user can clean the first inner space (410) by removing the cartridge (800) or foreign objects.

Although the present specification has explained the first cover (400) only, the second cover (500) may be also formed with a second opening (520), a second sliding part (540) and a second sliding groove (550), and these elements may be inferred and used mutatis mutandis through the explanation of first cover (400). However, the second cover (500) may be formed with a flat plated shape formed with no evaporation holes (430) in order to surface-contact the first cover (400) while the first cover (400) is formed with the evaporation holes (430), and the first inner space (410) is accommodated with the cartridge (800).

The hair iron according to an exemplary embodiment of the present disclosure may include a heater (600, 700).

A first heater (600) may be accommodated into the first body (100) to generate heat in order to transmit the heat to the first inner space (410). The first inner space (410) and the first cover (400) may be increased in temperature by the generation of heat. Furthermore, the first heater (600) may heat the cartridge (800, described later) at the first inner space (410). At this time, the first heater (600) may be electrically connected to an outside electric power (not shown) through a circuit accommodated inside of the first or second body (100, 200) or an electric connecting means, and may be supplied with an electric power from a battery embedded in the first or second body (100, 200). The first heater (600) may generate a heat by being supplied with a current, and at this time, means supplying the current may not be particularly limited to one means, and a manufacturer may adopt various means for the first heater (600) as long as the first heater (600) can generate a heat.

The second heater (700) may generate heat by being accommodated in the second body (200) in order to transmit the heat to a second inner space (510), and may be inferred mutatis mutandis from explanation of the first heater (600), and therefore no further explanation of second heater (700) will be omitted.

Meantime, albeit not being illustrated, the hair iron according to an exemplary embodiment of the present disclosure may be embedded with an earth (ground) means. For example, static electricity generated in the course of the user hair being styled may be removed by the earth means according to the present disclosure. That is, it is possible for the first or second body (100, 200) to include an earth means, and it is also possible for the hair iron to be disposed with an earth circuit.

The hair iron according to an exemplary embodiment of the present disclosure may further include a cartridge (800) arranged in the first inner space. The cartridge (800) may include hair styling (treatment) material. It is preferable that the hair styling material be in a liquefied state, and the hair styling material may be evaporated by generation of heat. Furthermore, the hair styling material may include a nutrient material capable of supplying nutrition to the user hair, and may fix the hair styles after being coated on the user hair, such as hair gel, for example.

The cartridge (800) may preferably be formed longer than a length of the first cover (400) or the second cover (500) to allow being removed in response to user selection after consumption of the hair styling material by being evaporated. The cartridge (800) may preferably be sold while being stored in an airtight container (not shown) that is interrupted from air, in order to prevent the hair styling material from being evaporated, and a user can draw out the cartridge by breaking the airtight container when the user intends to use the cartridge (800).

In order to prevent user hair from being damaged, and when the user sets a generated temperature of the first heater (600) at a relatively lower temperature (e.g., 100° C.) through a temperature adjusting part (900), the hair styling itself or hair styling process may not be performed smoother than expected at a higher temperature (e.g., 200° C.). Thus, the hair iron according to an exemplary embodiment of the present disclosure can perform the hair styling and the hair damaging prevention at the same time by evaporating the hair styling material, and coating the evaporated hair styling material on the user hair.

Although the exemplary embodiment of the present disclosure has explained that the first cover (400) formed with the evaporation holes (430) and the cartridge (800) are provided on the first body (100), the second body (200) has not been separately explained. The evaporation holes (430) may be selectively provided on the first cover (400) or the second cover (500), and the first cover (400) formed with the evaporation holes (430) and the cartridge (800) may be provided on the first body (100) or the second body (200), and the evaporation holes (430) may be provided on the first cover (400) and the second cover (500) altogether. Furthermore, each of the first cover (400) and the second cover (500) may be attachable to and detachable from the first body (100) or the second body (200), such that the user may select the arrangement of the first cover (400) formed with the evaporation holes (430) and the cartridge (800) from either the first body (100) or the second body (200).

For example, even if the evaporation holes (430) are formed on the first cover (400) and the cartridge (800) is arranged in the first inner space (410), a user can detach the first cover (400) from the first body (100) and the cartridge (800) from the first inner space (410) by sliding the first cover (400), and can detach the second cover (500) from the second body (200) and arrange the cartridge (800) in the second inner space (510) by sliding the second cover (500), and may exchange the arrangement position of the first cover (400) with that of the second cover (500).

The hair iron appliance according to an exemplary embodiment of the present disclosure may further include a temperature adjusting part (900) in order to set a temperature of cover (400, 500).

Although the temperature adjusting part (900) illustrated in FIGS. 1A and 1B is an exemplary embodiment for implementing the present disclosure, and illustrated in a rotatable disk shape, shape or arrangement of the temperature adjusting part (900) is not limited thereto and may be provided in various exemplary embodiments and modified examples in response to a manufacturer's intention.

Furthermore, it is possible for a user to set an upper limited (allowable) temperature and a lower limited (allowable) temperature through the temperature adjusting part (900), and it is also possible to set a generated heat temperature of the first cover (400) and a generated heat temperature of the second cover (500) at a different level respectively.

Meantime, when a user uses the hair iron of the present disclosure, that is, when the first cover (400) and the second cover (500) come mutually closer or mutually come to be contacted, the first heater (600) and the second heater (700) can generate a set temperature selected by the user. At this time, although not illustrated, the first body (100) and the second body (200) are pursed to press a switch (not shown) mounted on the first body (100) or the second body (200), whereby the generated temperature of the first heater (600) can be selected.

In other words, when the switch is pressed, the first heater (600) and the second heater (700) can generate a temperature set by the user. However, when the user does not use the hair iron of the present disclosure, that is, when the first cover (400) and the second cover (500) are in a separated state, and when the pushing or pressing of the switch is released while the switch is under being compressed, the first heater (600) or the second heater (700) may generate a heat at a lower temperature than a set temperature selected by the user, and the first cover (400) or the second cover (500) formed with the evaporation holes (430) may descend to a temperature lower than the set temperature selected by the user.

For example, when the evaporation holes (430) are formed on the first cover (400), the user's set temperature is 100° C., and the first cover (400) and the second cover (500) are separated, the first heater (600) may generate a heat at a lower temperature of 50° C., and the second heater (700) may maintain a temperature of 100° C. as it is. This is to prevent the hair styling material in the cartridge (800) from being evaporated by the first heater (600) when the user does not use the hair iron. Furthermore, this is also to shorten a time of increasing the temperature to 100° C. when the user uses the hair iron again by maintaining the heated temperature of the first heater at 50° C.

Figure 4A:
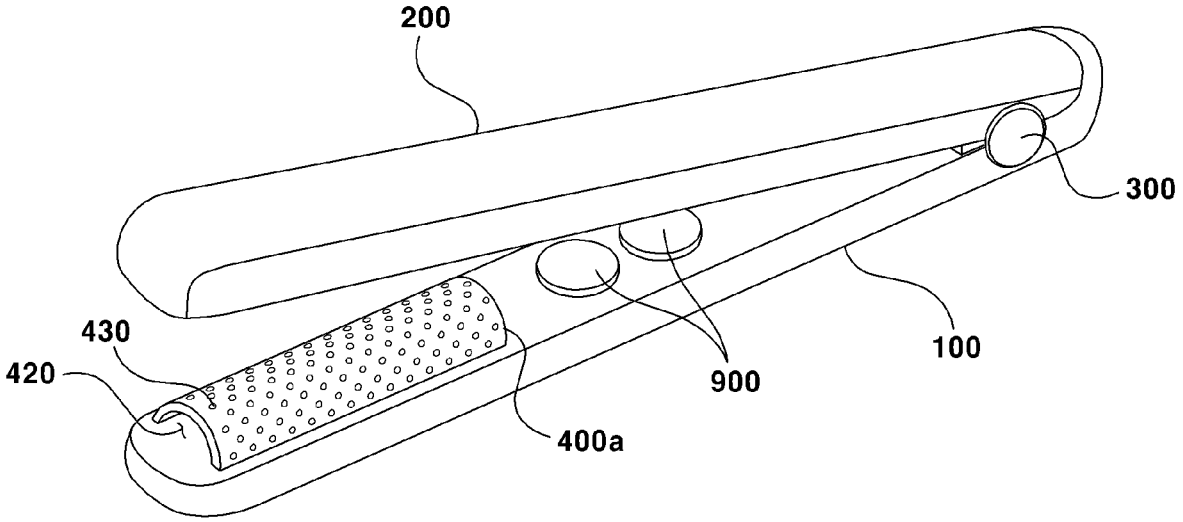
FIGS. 4A and 4B are perspective views illustrating a hair iron according to another exemplary embodiment of the present disclosure.
Figure 4B:
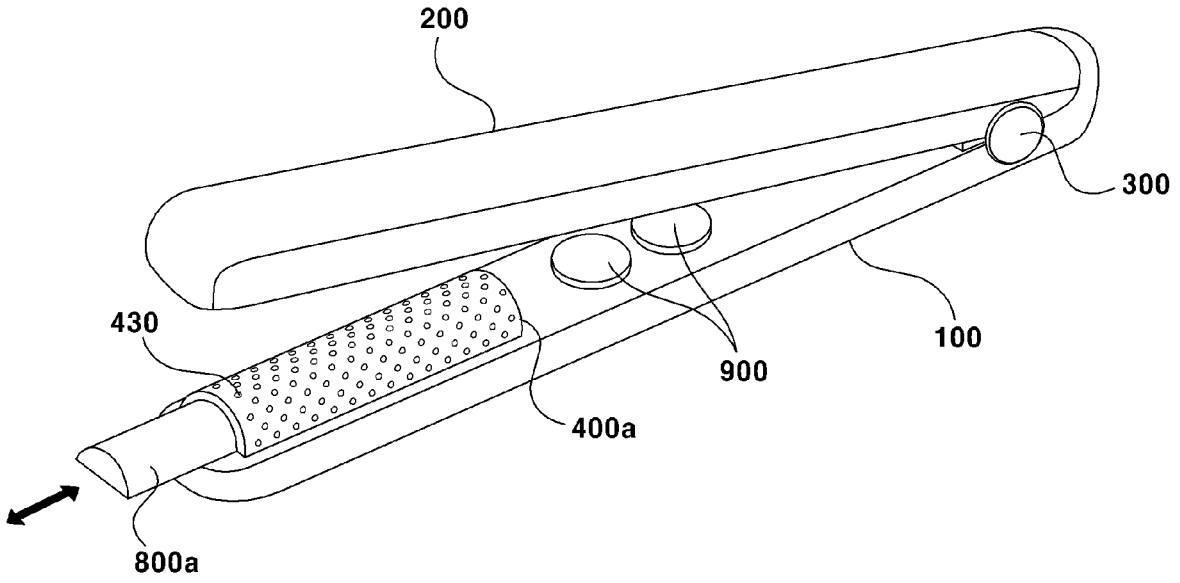

A first cover (400*a*) or a second cover (not shown) of the hair iron according to an exemplary embodiment of the present disclosure may take various shapes. For example, as illustrated in FIGS. 4A and 4B, the first cover (400*a*) may take a shape convex toward the second body (200). At this time, the second body (200) may take a concave shape corresponding to a convex surface of the first cover (400*a*). In addition to the shapes explained above, the first cover (400*a*) may take various shapes in terms of widthwise cross-section according to a manufacturer's intention such as a round, an oval, a semicircle, or a polygonal shape. Furthermore, the second cover (not shown) may be formed with a concave portion to allow being contacted by being inserted at a convex portion of the first cover (400*a*), and may be formed with a convex portion to allow being contacted by being inserted at the concave portion of the first cover (400*a*).

Now, operation procedure of a hair iron according to exemplary embodiments of the present disclosure will be described in detail.

First of all, a user may arrange the cartridge (800) at the first inner space (410). At this time, the user can push the cartridge (800) through the first opening (420). Furthermore, the first cover (400) may be detached from the first body (100), the cartridge (800) may be arranged at the first inner space (410), and the first cover (400) may be attached to the first body (100) by sliding the first body (400) to a lengthwise direction of the first body (100).

The user may electrically connect the hair iron of the present disclosure to allow a power to be supplied from an outside power source or an inside power source.

The user may manipulate the temperature adjusting part (900) to set a temperature of heat generated by the cover (400, 500) and may select an upper limit temperature and a lower limit temperature. For example, the user may set the temperature in such a manner that the cover (400, 500) can generate a heat at 100° C., whereby the upper limit temperature may be set at 110° C., and the lower limit temperature may be set at 50° C. Hereinafter, description will be made based on this reference of the upper limit temperature being set at 110° C., and the lower limit temperature being set at 50° C.

Successively, the user may grasp the first body (100) and the second body (200), and may position the user hair between the first body (100) and the second body (200), and apply a pressure to the user hair by pressing the first body (100) and the second body (200). At this time, because the first cover (400) and the second cover (500) are brought into contact, the first cover (400) and the second cover (500) can apply a heat to the user hair at a temperature of 100° C.

At this time, the liquefied hair styling material in the cartridge (800) accommodated into the first inner space (410) may be evaporated by the generated heat of the first cover (400), and the hair styling material may be coated on the user hair through the evaporation holes (430) of the first cover (400). A user can style his or her hair by pulling or twisting the hair iron of the present disclosure to the outside while the user grasps the hair iron under a compressed state.

Successively, a user can separate the first cover (400) from the second cover (500) by releasing the grasping power on the first body (100) and the second body (200). In this case, the first heater (600) may generate a heat descended to a temperature of 50° C., which is a lower limited temperature from a temperature of 100° C., which is a temperature set by the user, whereby evaporation of hair styling material in the cartridge (800) can be mitigated. At this time, it is preferable that the second heater (700) be maintained as it is with a set temperature of the user at 100° C. When the cartridge (800) is arranged at the first inner space (410) and the second inner space (510) as well, and the second cover (500) is also formed with the evaporation holes (430), the generated temperature of the first heater (600) and the generated heat of the second heater (700) may descend down to 50° C. altogether when the first cover (400) and the second cover (500) are separated.

When the user wants to use the hair iron of the present disclosure again, the hair is positioned between the first cover (400) and the second cover (500), and the grasping power on the first body (100) and the second body (200) is increased to allow the first cover (400) and the second cover (500) to be contacted. At this time, because the descended temperature of the first heater (600) is 50° C., and because the time to increase the temperature to 100° C. is shorter than the time to increase the temperature from 50° C. to 100° C., the user can use the hair iron again within a shorter and faster time.

Meantime, when all the hair styling material in the cartridge (800) is all evaporated, the user can detach a dried or used cartridge (800) from the first body (100) or the second body (200) by pulling a distal end of the cartridge (800) from the first body (100) or the second body (200) arranged with the used cartridge (800). Furthermore, it is also possible to remove the cartridge (800) from the first body (100) or the second body (200) by sliding the first cover (400) of the first body (100) or the second cover (500) of the second body (200) and exposing the cartridge (800) to the outside.

In addition, when the first cover (400) and the second cover (500) are slid to a lengthwise direction from the first body (100) or the second body (200) respectively, the first inner space (410) or the second inner space (510) can be exposed to the outside. Thereafter, even if the hair styling material of the cartridge (800) is smeared on the first body and second body (100, 200), and first cover and second cover (400, 500), a user can maintain the cleanness because the first and second inner spaces (410, 510) can be cleaned out. Whereby, the cause of fire or unhygienic state can be prevented in advance that may be generated from the hair styling material being accumulated, held together, or hardened.

The abovementioned exemplary embodiments of hair iron are intended to be illustrative, and not to limit the scope of the claims. Many alternatives, modifications, variations, and equivalents will be apparent to those skilled in the art. The features, structures, methods, and other characteristics of the exemplary embodiments described herein may be combined in various ways to obtain additional and/or alternative exemplary embodiments within an equivalent scope. Therefore, the technical scope of the rights for the present disclosure shall be decided by rational interpretation of the appended claims and equivalents thereof.

The invention claimed is:

1. A hair iron, comprising:

a first body coupled to second body through a hinge member, such that the first body and the second body face each other and hairs are placed between the first and second bodies;

a detachable first cover configured to form a first inner space when the first cover is attached to the first body and to transmit first heat to the hairs;

a first heater configured to generate the first heat by being accommodated into the first body and to transmit the first heat to the first cover;

a detachable second cover configured to form a second inner space when the second cover is attached to the second body facing the first cover and to transmit second heat to the hairs;

a second heater configured to generate the second heat by being accommodated into the second body and to transmit the second heat to the second cover;

a temperature adjusting part configured to set a temperature according to a user input such that:

at least one of the first heater or the second heater generates at least one of the first heat or the second heat according to the set temperature when the first cover and the second cover are in contact with each other; and a first cartridge including a liquefied hair styling material evaporable by the first heat generated by the first heater, wherein the first cartridge inserted into the first inner space is removable from the first inner space; and a second cartridge including the liquefied hair styling material evaporable by the second heat generated by the second heater, wherein the second cartridge inserted into the second inner space is removable from the second inner space, wherein each of the first cover or the second cover includes:

an opening configured to receive the first cartridge or the second cartridge; and a plurality of evaporation holes configured to allow passage of the hair styling material evaporated from the first cartridge and the second cartridge, respectively, and wherein the plurality of evaporation holes are arranged in a zigzag pattern along lengthwise and widthwise directions of the first cover or the second cover.

2. The hair iron of claim 1, wherein the first cover or the second cover is slidable along a lengthwise direction of the first body or along a lengthwise direction of the second body.

3. The hair iron of claim 2, wherein the first cover or the second cover includes a sliding part bent at both distal ends of widthwise direction toward an inside thereof, and a sliding groove formed at an inside to correspond to the sliding part, wherein the first body or the second body includes, a hitching lug so protruded as to be inserted into the sliding groove, and a hitching groove concavely formed at one side of the hitching lug to allow the sliding part to be inserted, and wherein the first cover or the second cover prevents the sliding part from being deviated by being hitched at the hitching lug.

4. The hair iron of claim 1, wherein each of the plurality of evaporation holes has a round shape.

* * * * *